US005361511A

United States Patent [19]

Brown

[11] Patent Number: 5,361,511

[45] Date of Patent: Nov. 8, 1994

[54] METHODS AND APPARATUS FOR TREATING THE EXHAUST AIR OF A CLOTHES DRYER

[76] Inventor: John R. Brown, 7800 Chase Ct., Manassas, Va. 22110

[21] Appl. No.: 99,654

[22] Filed: Jul. 30, 1993

[51] Int. Cl.[5] ..... F26B 21/08

[52] U.S. Cl. ..... 34/468; 34/77

[58] Field of Search ..... 34/77, 76, 32, 26, 27, 34/85

[56] References Cited

U.S. PATENT DOCUMENTS 3,866,333 2/1975 Sarukahanian et al. .
3,875,679 4/1975 Condit .
3,875,681 4/1975 De Pas .
4,489,507 12/1984 Kawai .
4,516,331 5/1985 Yamauchi et al. .
4,603,489 8/1986 Goldberg ..... 34/77
4,621,438 11/1986 Lanciaux .
4,640,022 2/1987 Suzuki et al. .

*Primary Examiner*—Henry A. Bennett
*Attorney, Agent, or Firm*—Burns, Doane, Swecker & Mathis

[57] ABSTRACT

Exhaust air from a clothes dryer is dried in an air treatment unit and returned to the dryer. The air treatment unit is manually portable and separate from the dryer. Air is circulated through the air treatment unit by means of the dryer fan. The dryer heating mechanism can be deactivated so that drying is effected by very dry, unheated air. Recirculation fans can be provided in the treatment unit for recirculating air a number of times through each compartment.

14 Claims, 1 Drawing Sheet

METHODS AND APPARATUS FOR TREATING THE EXHAUST AIR OF A CLOTHES DRYER

BACKGROUND OF THE INVENTION

The present invention relates generally to clothes dryers and in particular to methods and apparatus for treating the exhaust air of a clothes dryer.

Clothes dryers are known which are of the non-venting type, i.e., they contain a built-in dehumidifying mechanism for condensing the moisture from the moist exhaust air. That dried exhaust air is then conducted back into the dryer (e.g. see Lanciaux U.S. Pat. No. 4,621,438). Such a non-venting dryer can be used in dwellings which do not permit venting of utilities such as dryers. The dehumidifying mechanism may utilize a conventional refrigeration cycle wherein a compressor delivers refrigerant sequentially to a condenser section, an expansion valve, and an evaporator section. The dryer exhaust air is directed sequentially across the evaporator and condenser sections and then back to the dryer. In the evaporation section moisture in the exhaust air is condensed out and collected. In the condenser section, heat is returned to the dry air received from the evaporator section.

One shortcoming of known non-venting clothes dryers having a built-in dehumidifying mechanism is that they are expensive. Also, people already possessing a venting dryer who move into a dwelling where venting is prohibited find that their existing dryer is useless and must purchase an expensive non-venting dryer.

Furthermore, a non-venting dryer is heavier and mechanically more complex than a venting dryer, thereby being more susceptible to mechanical breakdown. If the humidifying mechanism suffers a breakdown, it cannot be conveniently taken to a repair shop due to the large size and weight of the dryer; rather, a repairman must come to the dryer.

Therefore, it would be desirable to enable the above discussed shortcomings to be alleviated.

SUMMARY OF THE INVENTION

One aspect of the present invention relates to the combination of a clothes dryer and a manually portable air treatment unit. The clothes dryer has an air inlet port, an air outlet port, and an air-circulating fan. The manually portable air treatment unit is separate from the dryer and functions to treat exhaust air received from the dryer. The air treatment unit comprises a housing having an air inlet port connect by a conduit to the air outlet port of the dryer, and an air outlet port connected by a conduit to the air inlet port of the dryer. A dehumidifying mechanism is disposed in the housing and includes an evaporator section and a condenser section. Moist air received from the dryer through the air inlet port of the air treatment unit is directed into contact sequentially with the evaporator section and the condenser section to cause moisture to be condensed from the air at the evaporator section and then raise the air temperature at the condenser section before the air is returned to the dryer.

Each of the air inlet and outlet ports of the dryer and air treatment unit comprises an outwardly projecting cylindrical duct. The conduits comprise flexible tubes which are fitted over the cylindrical ducts.

Other aspects of the present invention pertains to the manually portable air treatment unit per se, and to a method of treating exhaust air from a clothes dryer without venting such exhaust air. The method comprises the steps of providing a manually portable air treatment unit which is separate from the dryer. A first conduit is connected between an air exhaust port of the dryer and an inlet port of the air treatment unit. A second conduit is connected between an air outlet port of the air treatment unit and an air inlet port of the dryer. The dryer is operated to dry clothes, with a fan of the dryer circulating air in a closed loop sequentially through the dryer and the air treatment unit. Moist air entering the air inlet port of the air treatment unit is caused to contact an evaporator section of a dehumidifying mechanism for condensing-out moisture from the moist air, whereby the air is dried. The dried air from the evaporator section is caused to contact a condenser section of the dehumidifying mechanism, whereby the temperature of the air is raised prior to the return of the air into the dryer.

Preferably, the dryer is operated while a heating mechanism thereof is deactivated, whereby the clothes are dried by very dry, unheated air.

Recirculating fans can be disposed within the unit for recirculating the air numerous times through each compartment.

BRIEF DESCRIPTION OF THE DRAWINGS

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 1:
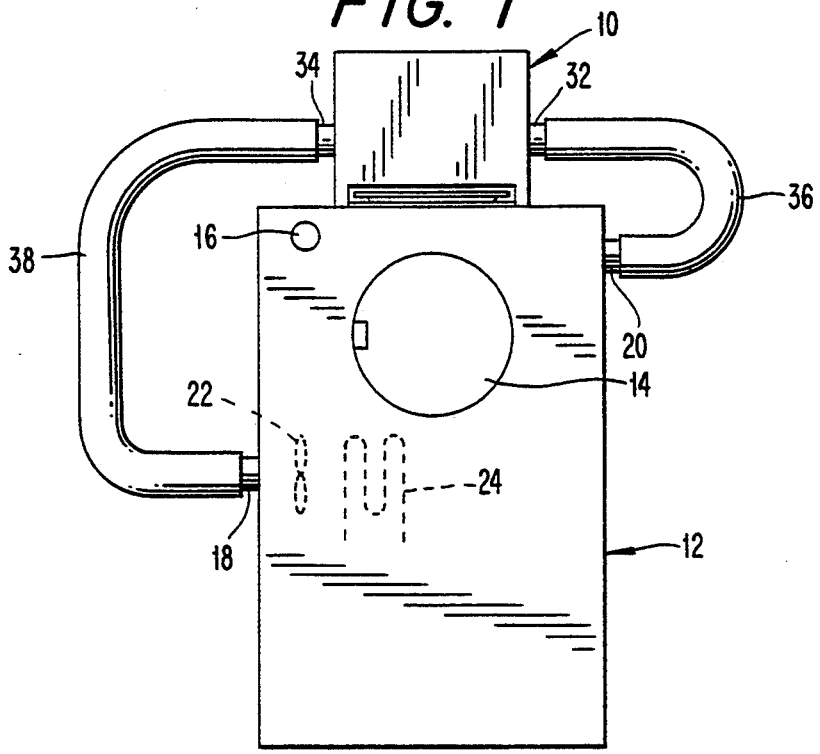
FIG. 1 is front elevational view of a conventional clothes dryer, and a manually portable air treatment unit according to the present invention seated on the dryer.

Depicted in FIG. 1 is a manually portable air treatment unit 10 according to the present invention which is separate from a tumble-type clothes dryer 12. The air treatment unit 10 is depicted in greater detail in FIG. 2.

The clothes dryer 12 comprises a conventional dryer designed and built to be of the venting type. It includes an access door 14, a manual control knob 16, an air inlet port in the form of a cylindrical duct 18, an air outlet port in the form of a cylindrical duct 20, a fan 22 for circulating air through the dryer, and an air heater 24.

The air treatment unit 10 is depicted as being seated atop the dryer 12, but it can be positioned anywhere in the vicinity of the dryer.

Figure 2:
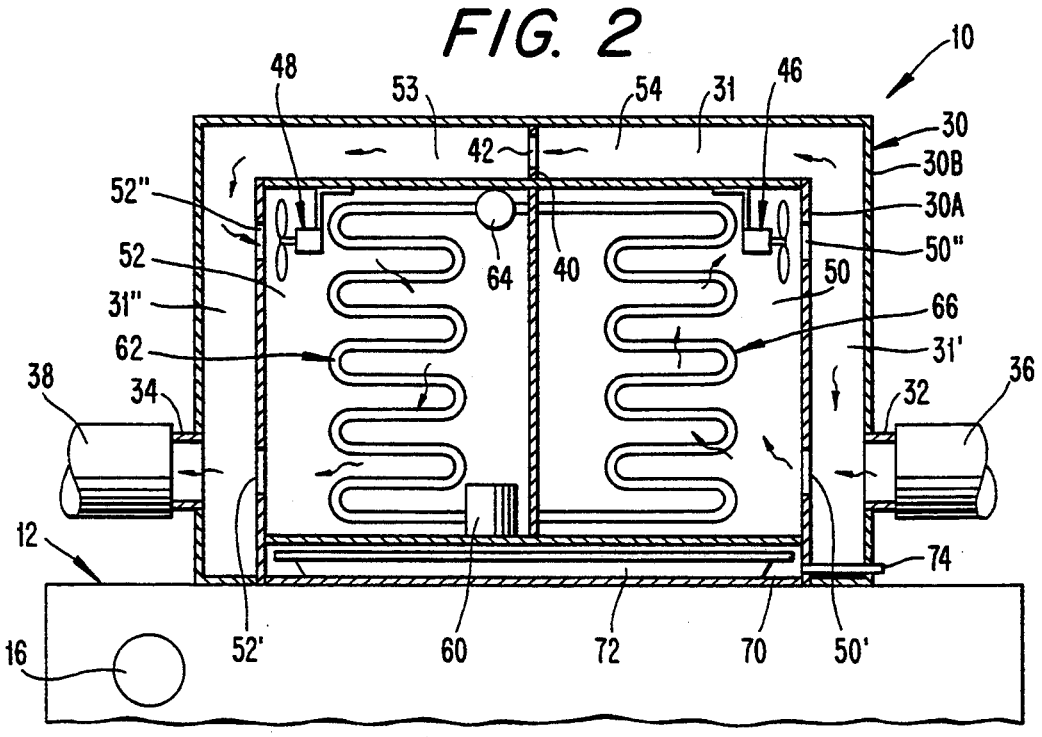
FIG. 2 is a vertical sectional view taken through the air treatment unit shown in FIG.

With reference to FIG. 2, The air treatment unit 10 includes a double wall housing 30 which includes outer and inner walls 30A, 30B. The outer wall 30B carries cylindrical air inlet and outlet ducts 32, 34. A conventional flexible conduit 36 connects the dryer outlet duct 20 with the air inlet duct 32 of the treatment unit 10. A conventional flexible conduit 38 connects the outlet duct 34 of the treatment unit 10 with the dryer inlet duct 18.

The inner wall 30A forms drying and heating compartments 50, 52, respectively. The inner and outer walls 30A, 30B together form a space 31 which surrounds the inner wall 30A. A wall 40 extends across the space 31 to divide the space into opposite sections 31', 31". The wall 40 includes a port 42 which communicates those sections 31' 31" with one another That port could be adjustable in size by a suitable manually actuable damper.

The inner wall 30A includes two ports 50', 50" which communicate the drying compartment 50 with the space 31'. Likewise, the inner wall 30A includes two ports 52' 52" which communicate the heating compartment 52 with the space 31". Fans 46, 48 are positioned adjacent the ports 50", 52", respectively. The fan 46 creates a circulation of air through the drying compartment 50 from the port 50' to the port 50" (or vice-versa if desired). The fan 48 creates a circulation of air through the heating compartment 52 from the port 52" to the port 52' (or vice-versa if desired).

Mounted in the unit is a humidifying mechanism employing a refrigeration cycle. That mechanism includes a compressor 60 which circulates a refrigerant fluid sequentially through a condenser section 62, an expansion valve 64, and an evaporator section 66 in a conventional manner. The condenser section 62 is disposed in the heating compartment 52, and the evaporator section 66 is disposed in the drying compartment 50. The volume of air circulated through the unit 10, i.e., into the inlet duct 32 and out of the outlet duct 34 is dependent upon the capacity of the motor 22 disposed in the heater. The recirculation fans 46, 48 disposed within the unit 10 are operated at a speed sufficient to establish a circulation within the compartments 50, 52 to cause the air to recycle a number of times through the drying compartment 50 before moving on to the port 42 and then to cause the air to recycle a number of times through the heating compartment 52 before moving on to the outlet duct 34. Hence, the heating and drying actions occurring within the unit will be maximized. The fans 46, 48 could be provided with adjustable speed motors so that the user could set a desired speed of those fans.

Within the drying compartment 50, moisture in the exhaust air 66 condenses on the cold evaporator coils 66 and is collected at the bottom of the drying compartment 50. A chamber 70 could be formed beneath the drying compartment 50 to house a removable container 72 which stores the condensate. Alternatively, the container could be eliminated, and a hose could be connected to a valved fitting 74 to enable the condensate to be conducted from the chamber 70 to a drain, if available.

In practice, air from the dryer is dried in the first compartment 50, while being recycled therethrough by the recirculation fan 46. Dried air travels through the port 42, and enters the heating compartment 52. Within the heating compartment, the air contacts the warm condenser coils 62 and is raised in temperature while being recycled by the fan 48. Dry, heated air travels through the conduit 38 back into the dryer.

If desired, the spaces 31', 31" could be eliminated. Instead, the conduits 36, 38 could directly communicate with the ports 50', 52', respectively, and the compartments 50, 52 would be placed in communication via a port formed in the wall separating those compartments. The fans 46, 48 could thus be eliminated.

It will be appreciated that the treatment unit 10 can be purchased separately from the dryer and then connected to a conventional venting-type dryer. The user need not purchase an expensive non-venting dryer with build-in dehumidifier merely because he or she has moved to a dwelling where dryer venting is prohibited or not possible.

Furthermore, since the treatment unit 10 is manually portable, it can be taken to a repair shop rather than requiring a repair person to make a house call. The unit 10 can be replaced without requiring that the dryer also be replaced.

It will be appreciated that the dry air exiting the treatment unit 10 may be substantially drier than the air normally sucked into the inlet of a venting type dryer during normal venting operation thereof. Thus, a very efficient drying can be performed by the present invention without the need for utilizing the heater mechanism 24 of the dryer. That is, drying would be performed by the cooler, but much drier, air exiting the treatment unit 10. The heater mechanism 24 can therefore be deactivated, whereby the dryer could be operated from a 110 volt electrical source rather than a 220 volt source. This is useful if the dwelling does not possess a conveniently located 220 volt source typically needed to operate an electric heating mechanism in a clothes dryer.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. In combination:

a clothes dryer having an air inlet port, an air outlet port, and an air-circulating fan, and a manually portable air treatment unit separate from said dryer for treating exhaust air received therefrom, said air treatment unit comprising:

a housing having an air inlet port connected by a conduit to said air outlet port of said dryer, and an air outlet port connected by a conduit to said air inlet port of said dryer, a dehumidifying mechanism in said housing including an evaporator section and a condenser section, and means directing moist air received through said air inlet port of said air treatment unit into contact sequentially with said evaporator section and said condenser section, to cause moisture to be condensed from the air at said evaporator section and then cause the air temperature to be raised at said condenser section before the air is returned to said dryer.

2. The combination according to claim 1, wherein said housing includes a drying compartment containing said evaporator section and communicating with said inlet port of said air treatment unit, a heating compartment containing said condenser section and communicating with said outlet port of said air treatment unit, and means interconnecting said compartments.

3. The combination according to claim 1, wherein each of said air inlet and outlet ports of said dryer and said air treatment unit comprises an outwardly projecting cylindrical duct, said conduits comprising flexible conduits fitted over said cylindrical ducts.

4. The combination according to claim 1 including recirculation means for recirculating air repeatedly through each of said compartments.

5. The combination according to claim 4, wherein said recirculation means comprises a recirculation fan for each compartment.

6. The combination according to claim 5, wherein each compartment communicates with a surrounding passage so that each of said recirculation fans circulates air out of the respective compartment and then back into that compartment.

7. A manually portable air treatment unit arranged to be connected to a clothes dryer for treating exhaust air from a clothes dryer which is separate from said air treatment unit, said air treatment unit comprising:

a manually portable housing separate from that of a clothes dryer and having a drying compartment and a heating compartment interconnected by a passage, outwardly projecting cylindrical ducts communicating with respective ones of said compartments to define air inlet and outlet ports for said drying and heating compartments, respectively, said air inlet port and air outlet port arranged to be connected to an air outlet and an air inlet, respectively of a clothes dryer, and a dehumidifying mechanism disposed in said housing and including a compressor, a condenser section, an expansion valve, and an evaporator section, said evaporator section being situated in said drying compartment for condensing-out moisture disposed in moist air circulating through said air treatment unit, said condenser section disposed in said heating compartment for raising the temperature of dry air received from said drying compartment.

8. The combination according to claim 7 including recirculation means for recirculating air repeatedly through each of said compartments.

9. The combination according to claim 8, wherein said recirculation means comprises a recirculation fan for each compartment.

10. The combination according to claim 9, wherein each compartment communicates with a surrounding passage so that each of said recirculation fans circulates air out of the respective compartment and then back into that compartment.

11. A method of treating the exhaust air from a clothes dryer without venting such exhaust air, comprising the steps of:

providing a manually portable air treatment unit which is separate from said dryer;

connecting a first conduit between an air exhaust port of said dryer and an air inlet port of said air treatment unit;

connecting a second conduit between an air outlet port of said air treatment unit and an air inlet port of said dryer;

operating said dryer to dry clothes, with a fan of said dryer circulating air in a closed loop sequentially through said dryer and said air treatment unit;

causing moist air entering said air inlet port of said air treatment unit to contact an evaporator section of a dehumidifying mechanism for condensing-out moisture from said moist air, whereby the air is dried and; and causing said dried air from said evaporator section to contact a condenser section of said dehumidifying mechanism, whereby the temperature of said air is raised prior to the return of said air into said dryer.

12. A method according to claim 11, wherein said operating step comprises operating said dryer, while a heating mechanism of said dryer is deactivated.

13. A method according to claim 11 including the step of actuating recirculation fans for recirculating the air repeatedly through each compartment.

14. A method according to claim 13, wherein air is recirculated out of and then back into each compartment a plurality of times.

* * * * *